US008915233B2

(12) United States Patent
Mitsudou et al.

(10) Patent No.: US 8,915,233 B2
(45) Date of Patent: Dec. 23, 2014

(54) FUEL SUPPLY EQUIPMENT

(75) Inventors: Hideo Mitsudou, Chiyoda-ku (JP); Masaru Hiraiwa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 990 days.

(21) Appl. No.: 12/768,470

(22) Filed: Apr. 27, 2010

(65) Prior Publication Data

US 2011/0126808 A1 Jun. 2, 2011

(30) Foreign Application Priority Data

Dec. 1, 2009 (JP) ..... 2009-273483

(51) Int. Cl.

| | |
|---|---|
| ***F02M 37/04*** | (2006.01) |
| ***F02M 37/10*** | (2006.01) |
| ***F02M 37/00*** | (2006.01) |
| ***F02M 37/22*** | (2006.01) |

(52) U.S. Cl.

CPC ..... *F02M 37/103* (2013.01); *F02M 37/0052* (2013.01); *F02M 37/22* (2013.01); *F02M 37/0029* (2013.01)

USPC ..... 123/509; 123/511

(58) Field of Classification Search

CPC ..... F02M 37/00; F02M 37/04; F02M 37/10; F02M 37/103

USPC ..... 123/509, 511, 461, 495, 497, 506, 514

See application file for complete search history.

(56) References Cited

U.S. PATENT DOCUMENTS

| | | | | |
|---|---|---|---|---|
| 6,065,452 | A * | 5/2000 | Yoshioka | 123/509 |
| 6,231,318 | B1 * | 5/2001 | Cotton et al. | 417/423.1 |
| 6,502,558 | B1 * | 1/2003 | Brunel | 123/509 |
| 6,964,264 | B2 * | 11/2005 | Yoshioka | 123/509 |
| 7,367,324 | B2 | 5/2008 | Izutani et al. | |
| 7,513,243 | B2 * | 4/2009 | Nakagawa et al. | 123/509 |

(Continued)

FOREIGN PATENT DOCUMENTS

| | | | |
|---|---|---|---|
| CN | 1851253 | A | 10/2006 |
| CN | 101061307 | A | 10/2007 |

(Continued)

OTHER PUBLICATIONS

Chinese Office Action issued Jan. 25, 2013 in Patent Application No. 201010219863.X.

(Continued)

*Primary Examiner* — Mahmoud Gimie
*Assistant Examiner* — David Hamaoui
(74) *Attorney, Agent, or Firm* — Sughrue Mion, PLLC

(57) ABSTRACT

A fuel supply equipment includes: a lid member provided with a fuel discharge pipe; a fuel pump held by the lid member and configured to suck in fuel within the fuel tank and discharge the fuel to an outside of the fuel tank from the fuel discharge pipe; a suction filter that filters the fuel within the fuel tank that will be sucked into the fuel pump; a fuel filter that removes foreign matter in the fuel discharged from the fuel pump; a pressure regulator configured to adjust a pressure of the fuel discharged from the fuel filter to a predetermined pressure and discharge excess fuel; a case configured to accommodate the fuel pump, the suction filter, the fuel filter, and the pressure regulator; and a supporting member provided to the lid member to support the case on the lid member.

5 Claims, 6 Drawing Sheets

(56) References Cited

U.S. PATENT DOCUMENTS

| | | | | |
|---|---|---|---|---|
| 8,220,437 | B2 * | 7/2012 | Yamada et al. | 123/509 |
| 2005/0172937 | A1 * | 8/2005 | Torii et al. | 123/509 |
| 2005/0201877 | A1 * | 9/2005 | Mitsudou | 417/423.14 |
| 2006/0236982 | A1 | 10/2006 | Izutani et al. | |
| 2007/0095332 | A1 * | 5/2007 | Sakai | 123/509 |
| 2007/0199884 | A1 * | 8/2007 | Nakagawa | 210/416.4 |
| 2009/0000601 | A1 * | 1/2009 | Takata | 123/510 |
| 2009/0007527 | A1 * | 1/2009 | Mitsudou | 55/290 |

FOREIGN PATENT DOCUMENTS

| | | | |
|---|---|---|---|
| JP | 11321353 | A | 11/1999 |
| JP | 2001140722 | A | 5/2001 |
| JP | 2005-16519 | A | 1/2005 |
| JP | 2006-299940 | A | 11/2006 |
| JP | 4203751 | B2 | 10/2008 |
| JP | 2009236006 | A | 10/2009 |
| JP | 2009257308 | A | 11/2009 |
| WO | 9925975 | A1 | 5/1999 |
| WO | 2006/134641 | A1 | 12/2006 |

OTHER PUBLICATIONS

Japanese Office Action dated Jul. 9, 2013 issued in corresponding Japanese Patent Application No. 2009-273483.

* cited by examiner

FUEL SUPPLY EQUIPMENT

BACKGROUND OF THE INVENTION

1. Field of the Invention

The present invention relates to a fuel supply equipment attached to a bottom wall of a fuel tank storing fuel and including a lid member filled in an opening made in the bottom wall and provided with a fuel discharge pipe and a fuel pump held by the lid member and configured to suck in fuel within the fuel tank and discharge the fuel to the outside of the fuel tank from the fuel discharge pipe.

2. Description of the Related Art

A fuel supply equipment in the related art used in a vehicle, such as a two-wheeled motor vehicle, includes a lid member that clogs an opening made in the bottom wall of the fuel tank, a fuel pump that discharges fuel, a fuel filter that filters fuel discharged from the fuel pump, and a filter case that accommodates and supports the foregoing members. The filter case is supported on the lid member with a supporting member. An example of this configuration is described in Japanese Patent No. 4203751 (Publication Date: 2009. Jan. 7) with reference to FIG. 1.

The lid member is formed in a bottomed tubular shape and has a lid portion and a tube portion. The lid member and the filter case are joined by engaging a window in the tube portion with a claw of the filter case using a snap fit. Accordingly, the lid member supports the fuel supply equipment. An example of this configuration is described in Japanese Patent No. 4203751 (Publication Date: 2009. Jan. 7) with reference to FIG. 4.

According to the configurations described above, excess fuel discharged from a pressure regulator is accumulated in the tube portion of the lid member of a bottomed tubular shape, so that running out of fuel occurring, for example, when the vehicle has inclined, is prevented by letting a suction filter suck in the accumulated excess fuel.

The fuel supply equipment in the related art described above has the lid member of a bottomed tubular shape configured to accumulate excess fuel discharged from the pressure regulator in the tube portion. However, because this configuration makes the lid member larger in size, there arises a problem that a mold cost is increased. Also, because the suction filter directly sucks in air bubbles contained in excess fuel discharged from the pressure regulator, there arises another problem that fuel supplied from the fuel supply equipment contains considerable air bubbles and adverse effects are given to the engine to which the fuel is supplied.

SUMMARY OF THE INVENTION

The invention was devised to solve the problems discussed above and has an object to provide a fuel supply equipment that neither increases an initial cost, such as a mold cost, nor gives adverse effects to the engine to which the fuel is supplied.

A fuel supply equipment according to an aspect of the invention is attached to a bottom wall of a fuel tank storing fuel and includes: a lid member filled in an opening made in the bottom wall and provided with a fuel discharge pipe; a fuel pump held by the lid member and configured to suck in the fuel within the fuel tank and discharge the fuel to an outside of the fuel tank from the fuel discharge pipe; a suction filter provided on a suction side of the fuel pump to filter the fuel within the fuel tank that will be sucked into the fuel pump; a fuel filter provided on a discharge side of the fuel pump to remove foreign matter in the fuel discharged from the fuel pump; a pressure regulator configured to adjust a pressure of the fuel discharged from the fuel filter to a predetermined pressure and discharge excess fuel of the fuel; a case configured to accommodate the fuel pump, the suction filter, the fuel filter, and the pressure regulator and accumulate therein the excess fuel discharged from the pressure regulator; and a supporting member provided to the lid member to support the case on the lid member.

A fuel supply equipment according to another aspect of the invention is attached to a bottom wall of a fuel tank storing fuel and includes: a lid member filled in an opening made in the bottom wall and provided with a fuel discharge pipe; a fuel pump held by the lid member and configured to suck in the fuel within the fuel tank and discharge the fuel to an outside of the fuel tank from the fuel discharge pipe; a suction filter provided on a suction side of the fuel pump to filter the fuel within the fuel tank that will be sucked into the fuel pump; a fuel filter provided on a discharge side of the fuel pump to remove foreign matter in the fuel discharged from the fuel pump; a pressure regulator configured to adjust a pressure of the fuel discharged from the fuel filter to a predetermined pressure and discharge excess fuel of the fuel; and a case configured to accommodate the fuel pump, the suction filter, the fuel filter, and the pressure regulator and accumulate therein the excess fuel discharged from the pressure regulator. The lid member and the case are made of thermoplastic resin and the lid member and the case are fixedly attached to each other by thermal welding.

It thus becomes possible to obtain a fuel supply equipment that neither increases an initial cost, such as a mold cost, nor gives adverse effects to the engine to which the fuel is supplied.

The foregoing and other objects, features, aspects and advantages of the present invention will become more apparent from the following detailed description of the present invention when taken in conjunction with the accompanying drawings.

DETAILED DESCRIPTION OF THE INVENTION

First Embodiment

Figure 1:
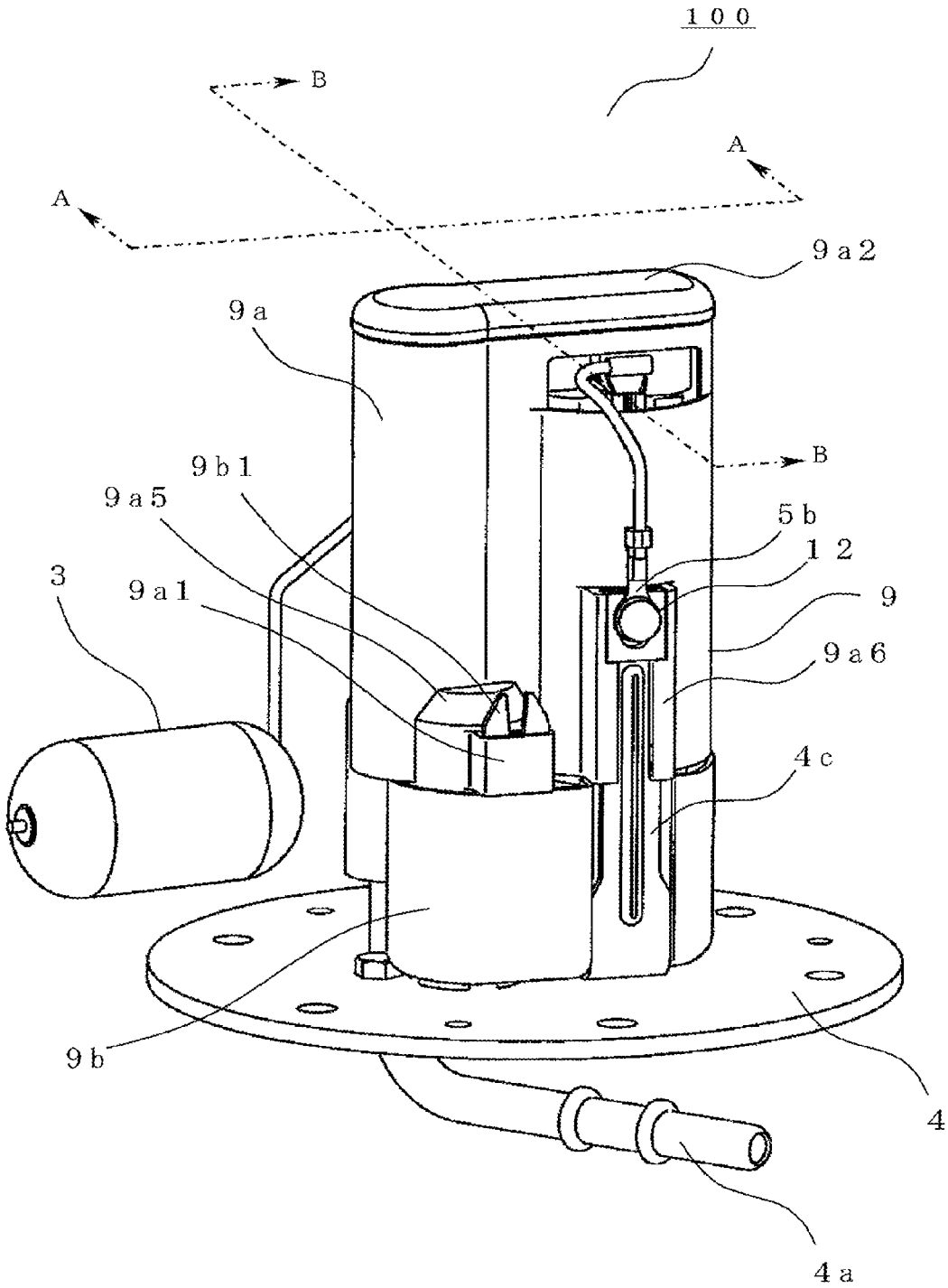
FIG. 1 is an outward perspective view showing a fuel supply equipment according to a first embodiment of the invention.
Figure 2:
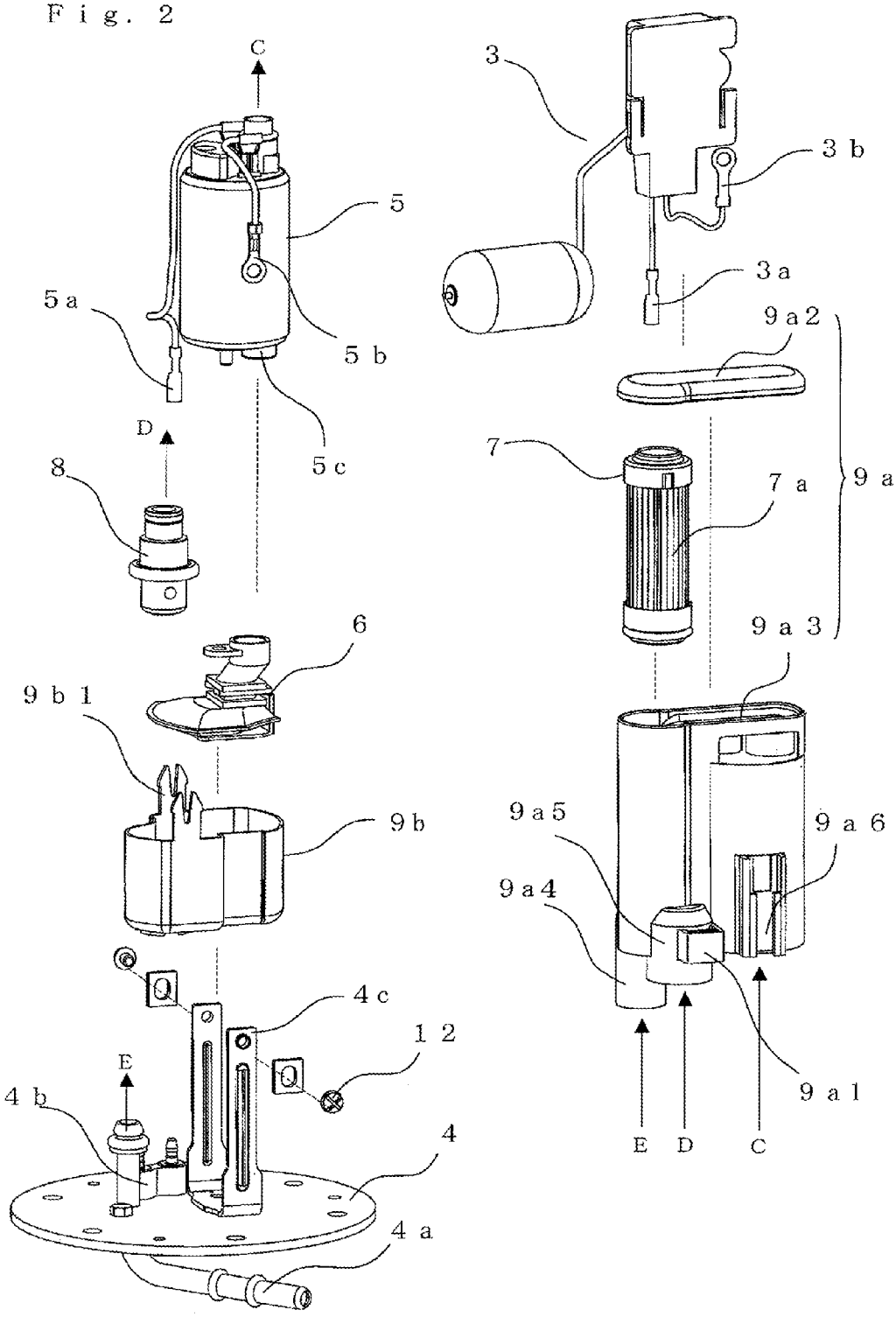
FIG. 2 is an exploded perspective view showing the fuel supply equipment according to the first embodiment of the invention.
Figure 3:
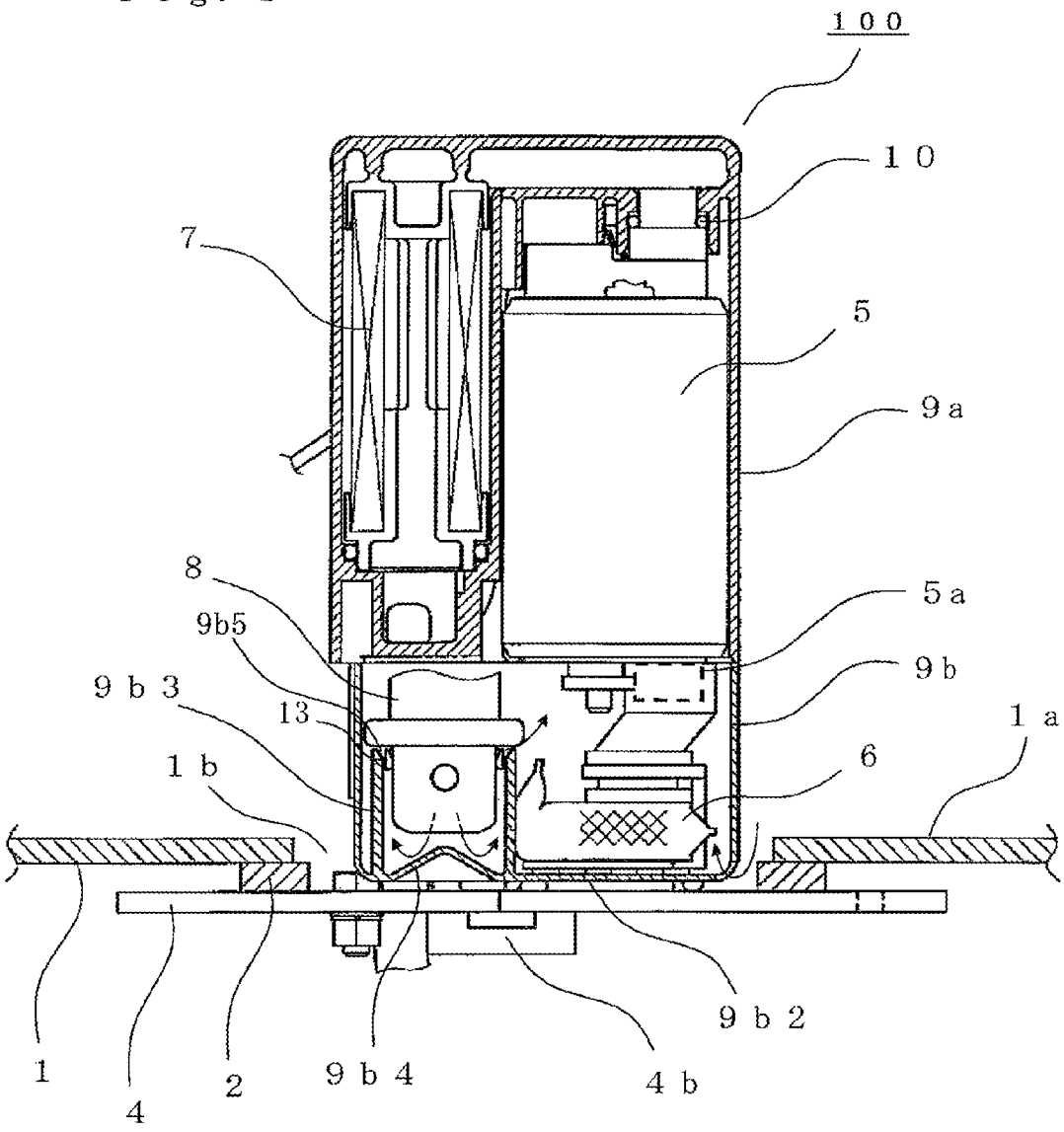
FIG. 3 is a cross section of the fuel supply equipment according to the first embodiment of the invention taken on line A-A of FIG. 1.

Hereinafter, a first embodiment of the invention will be described on the basis of FIG. 1 through FIG. 5. FIG. 1 is an outward perspective view showing a fuel supply equipment according to the first embodiment of the invention. FIG. 2 is an exploded perspective view showing the fuel supply equipment according to the first embodiment of the invention. FIG.

Figure 4:
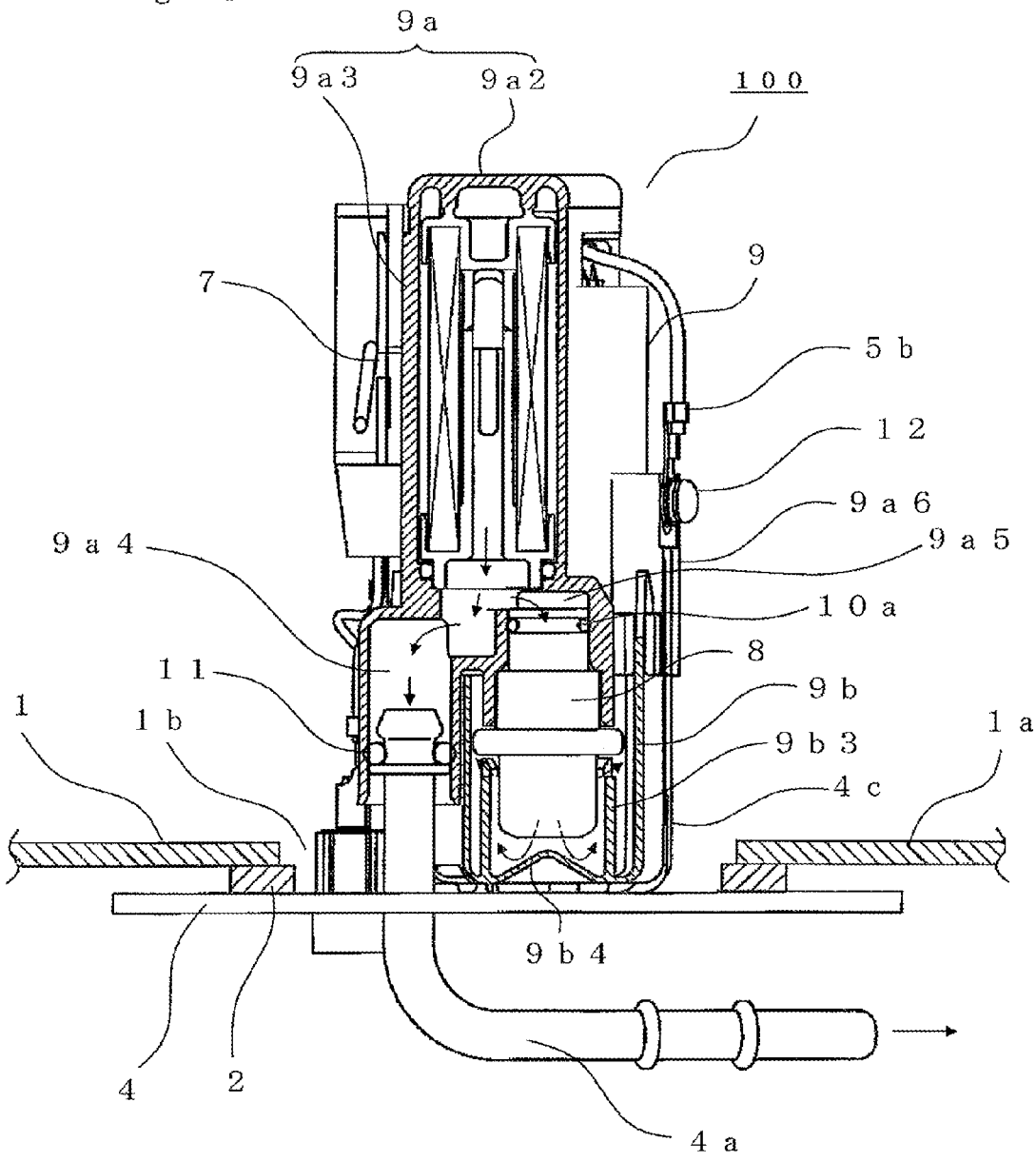
FIG. 4 is a cross section of the fuel supply equipment according to the first embodiment of the invention taken on line B-B of FIG. 1.
Figure 5:
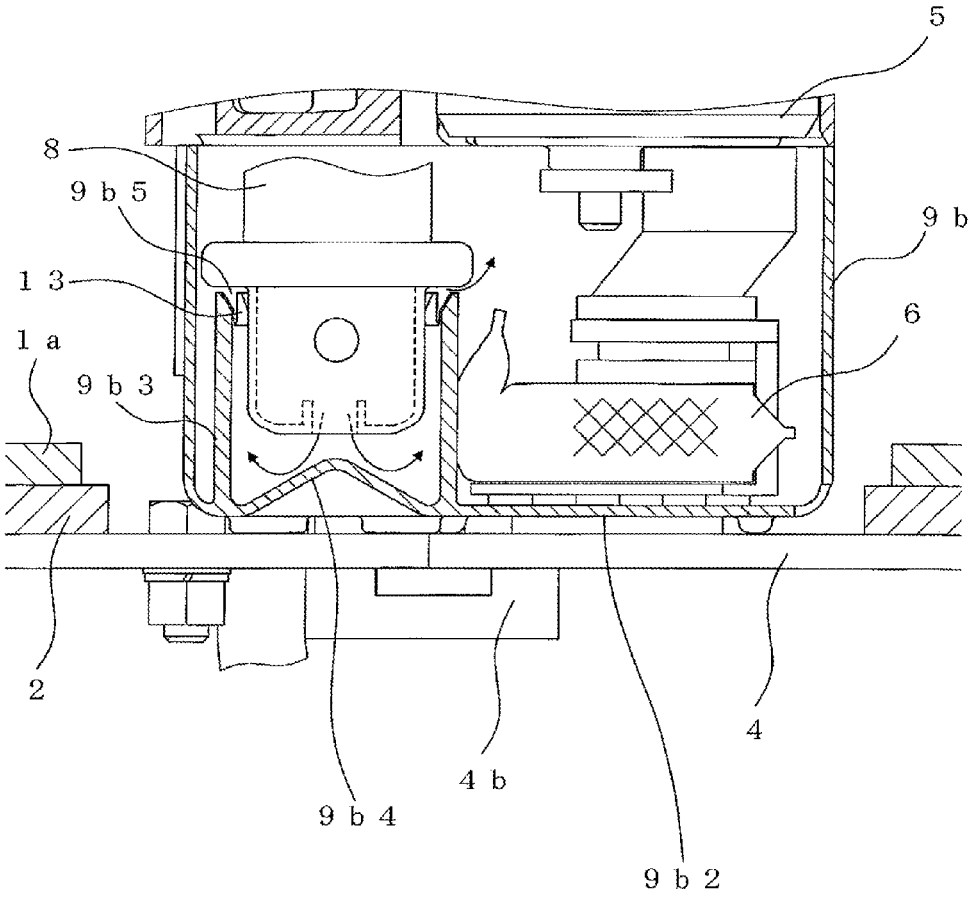
FIG. 5 is an enlarged cross section of a major portion of the fuel supply equipment according to the first embodiment of the invention.

3 is across section of the fuel supply equipment according to the first embodiment of the invention taken on line A-A of FIG. 1. FIG. 4 is a cross section of the fuel supply equipment according to the first embodiment of the invention taken on line B-B of FIG. 1. FIG. 5 is an enlarged cross section of a major portion of the fuel supply equipment according to the first embodiment of the invention.

Referring to these drawings, a fuel supply equipment 100 is filled in an opening 1*b* made in a bottom wall 1*a* of a fuel tank 1 for two-wheeled motor vehicle, which is one type of vehicle, using an unillustrated bolt via a packing 2 formed, for example, of a rubber plate.

A flange 4 serving as a lid member that covers the opening 1*b* of the fuel supply equipment 100 is formed of an iron plate in a disc shape. A fuel discharge pipe 4*a*, an electric connector 4*b*, and an attachment stay 4*c* serving as a supporting member are integrally molded with the flange 4.

The fuel discharge pipe 4*a* provided to the flange 4 is a tube that delivers fuel discharged from a fuel pump 5 described below to the outside of the fuel tank 1. In other words, fuel discharged from the fuel pump 5 is supplied to the engine installed outside the fuel tank 1 via the fuel discharge pipe 4*a*.

The electric connector 4*b* provided to the flange 4 is electrically connected to the fuel pump 5 and a liquid level gauge 3 with a lead wire 5*a* of the fuel pump 5 and a lead wire 3*a* of the liquid level gauge 3, respectively.

Besides the flange 4, the fuel supply equipment 100 has the fuel pump 5 that sucks in fuel within the fuel tank 1 and discharges the fuel, a suction filter 6 provided on the suction side of the fuel pump 5 to filter fuel within the fuel tank 1 that will be sucked into the fuel pump 5, a fuel filter 7 provided on the discharge side of the fuel pump 5 to remove foreign matter in fuel discharged from the fuel pump 5 using a filter element 7*a* formed of filter paper, such as non-woven fabric, a pressure regulator 8 not only adjusting a pressure of fuel discharged from the fuel filter 7 to a predetermined pressure but also discharging excess fuel of fuel discharged from the fuel filter 7, and a case 9 accommodating the fuel pump 5, the suction filter 6, the fuel filter 7, and the pressure regulator 8 and made, for example, of resin.

The case 9 is formed of a first case 9*a* that accommodates the fuel pump 5 and the fuel filter 7 and a second case 9*b* that accommodates the pressure regulator 8 and the suction filter 6. The first case 9*a* and the second case 9*b* are fixedly attached to each other by locking an engaging convex portion 9*b*1 of the latter in an engaging concave portion 9*a*1 of the former (shown in FIG. 2) with a snap fit serving as a latching means.

The first case 9*a* is formed of a case cover 9*a*2 and a case main body 9*a*3 and the former and the latter are fixedly attached to each other, for example, by known thermal plate welding after the fuel filter 7 is fit by insertion into the case main body 9*a*3.

In addition, excess fuel discharged from the pressure regulator 8 is accumulated in the second case 9*b*.

The fuel pump 5 and the pressure regulator 8 are accommodated in and fixed to the first case 9*a*, respectively, via O-rings 10 and 10*a* (shown in FIG. 3 and FIG. 4, respectively) serving as airtight members.

The fuel pump 5 is provided with a suction opening 5*c* (shown in FIG. 2) through which to suck in fuel within the fuel tank 1. The suction filter 6 that filters out dirt in the fuel is fixedly attached to the suction opening 5*c*.

The second case 9*b* is a component in which excess fuel discharged from the pressure regulator 8 is accumulated so that the accumulated excess fuel is sucked into the suction filter 6.

Air bubble suppressing members 9*b*3 and 9*b*4 (shown in FIG. 5) that suppress air bubbles in excess fuel discharged from the pressure regulator 8 are provided to a bottom portion 9*b*2 of the second case 9*b*.

The air bubble suppressing member 9*b*3 is formed of a tubular body provided to an excess fuel discharge portion of the pressure regulator 8. The air bubble suppressing member 9*b*4 is formed of a conical body provided consecutively with the bottom portion of the air bubble suppressing member 9*b*3 formed of a tubular body. The drawings shows a case where the second case 9*b* and the air bubble suppressing members 9*b*3 and 9*b*4 are integrally molded using a resin material by way of example.

The first case 9*a* is of an elliptical flat shape. As is shown in FIG. 2, the fuel pump 5 is inserted into the right side of the case main body 9*a*3 from below as is indicated by an arrow C and the fuel filter 7 having a small diameter and formed long in the longitudinal direction is inserted into the left side of the case main body 9*a*3 from above. When configured in this manner, the assembling performance when attaching the fuel supply equipment 100 to the fuel tank 1 can be enhanced.

As with the first case 9*a*, the second case 9*b* is also of an elliptical flat shape. As is shown in FIG. 2, the suction filter 6 is accommodated on the right side of the second case 9*b* and the pressure regulator 8 is accommodated on the left side of the second case 9*b*.

The upper side of the pressure regulator 8 is attached by insertion into a second discharge chamber 9*a*5 formed in the case main body 9*a*3 of the first case 9*a* from below as is indicated by an arrow D.

As is shown in FIG. 4, part of fuel discharged from the fuel filter 7 flows in from the upper side of the pressure regulator 8 provided in the second discharge chamber 9*a*5 formed in the case main body 9*a*3 of the first case 9*a*, so that a pressure of the fuel discharged from the fuel filter 7 is adjusted. Excess fuel flown into the pressure regulator 8 is then discharged from the pressure regulator 8.

The fuel discharge pipe 4*a* is attached by insertion into a first discharge chamber 9*a*4 formed in the case main body 9*a*3 of the first case 9*a* from below as is indicated by an arrow E (shown in FIG. 2) by inserting through the second case 9*b*.

As is indicated by arrows of FIG. 4, fuel discharged from the fuel filter 7 is discharged into the first discharge chamber 9*a*4 formed in the case main body 9*a*3 of the first case 9*a*. The fuel discharged into the first discharge chamber 9*a*4 is then supplied to the outside of the fuel tank 1 through the fuel discharge pipe 4*a*.

With the case 9 accommodating the fuel pump 5, the suction filter 6, the fuel filter 7, and the pressure regulator 8 as described above, the fuel discharge pipe 4*a* provided to the flange 4 is fit by insertion into the first discharge chamber 9*a*4 of the first case 9*a* via an O-ring 11 (shown in FIG. 4) serving as an airtight member while an earth wire 5*b* of the fuel pump 5 and an earth wire 3*b* of the liquid level gauge 3 are attached fixedly by a fastening member 12 after the attachment stay 4*c* serving as a supporting member is fit by insertion into a fit-insertion portion 9*a*6 of the first case 9*a*.

In the fuel supply equipment 100 according to the first embodiment of the invention configured as above, when the fuel pump 5 is driven, an impeller serving as a rotation member rotating with a motor serving as an electric drive portion not shown herein inside the fuel pump 5 starts to rotate and fuel within the fuel tank 1 is sucked in and discharged in association with rotations of the impeller. Fuel within the fuel tank 1 is filtered while the fuel flows through the suction filter 6 in association with rotations of the bladed wheel of the impeller and then sucked into the fuel pump 5.

Subsequently, foreign matter in the fuel discharged from the fuel pump 5 is removed while the fuel flows through the filter element 7*a* of the fuel filter 7. The fuel discharged from the fuel filter 7 is adjusted to have a predetermined pressure by the pressure regulator 8 and discharged to the outside of the fuel tank 1 from the fuel discharge pipe 4*a*. The fuel is supplied further to injectors or the like of the internal combustion engine not shown herein.

In a case where the pressure of fuel discharged from the fuel filter 7 is higher than a predetermined value, excess fuel is returned into the second case 9*b* by the pressure regulator 8, so that the pressure is maintained at the predetermined value.

An operation for excess fuel discharged from the pressure regulator 8 to be returned to the second case 9*b* and accumulated therein will now be described.

Excess fuel discharged from the pressure regulator 8 contains air bubbles. Accordingly, when the suction filter 6 excessively sucks in air bubbles and fuel containing air bubbles is supplied to the engine through the fuel discharge pipe 4*a*, the supplied fuel can cause an engine malfunction. In order to avoid this inconvenience, it is necessary to prevent air bubbles from being sucked into fuel that will be supplied to the engine.

Because excess fuel discharged from the pressure regulator 8 flows into the air bubble suppressing member 9*b*3, it is configured in such a manner that excess fuel containing air bubbles does not directly fall on the suction filter 6 provided adjacently to the air bubble suppressing member 9*b*3. A convection flow is developed by a function of the conical shape of the air bubble suppressing member 9*b*4. Hence, not only are air bubbles contained in the excess fuel reduced but also air bubbles become smaller. The excess fuel in this state flows into the second case 9*b* from a top space 9*b*5 in the air bubble suppressing member 9*b*3.

Also, air bubbles remaining in the excess fuel flown into the second case 9*b* from the top space 9*b*5 in the air bubble suppressing member 9*b*3 are lighter than fuel and therefore rise up in the second case 9*b*. In other words, air bubbles rise up to a position remote from the suction filter 6. It thus becomes possible to lower a possibility that air bubbles are substantially sucked into the suction filter 6.

In the fuel supply equipment 100 according to the first embodiment of the invention configured as above, the second case 9*b* that not only accommodates the pressure regulator 8 and the suction filter 6 but also accumulates therein excess fuel discharged from the pressure regulator 8 can be compact. It thus becomes possible to obtain a fuel supply equipment capable of reducing an initial cost, such as a mold cost.

Also, air bubbles contained in excess fuel discharged from the pressure regulator 8 are reduced markedly by the air bubble suppressing members 9*b*3 and 9*b*4 and rise up in the second case 9*b*. Accordingly, air bubbles are hardly sucked in through the suction filter 6. It thus becomes possible to obtain a fuel supply equipment that does not give adverse effects to the engine to which fuel is supplied.

Second Embodiment

Figure 6:
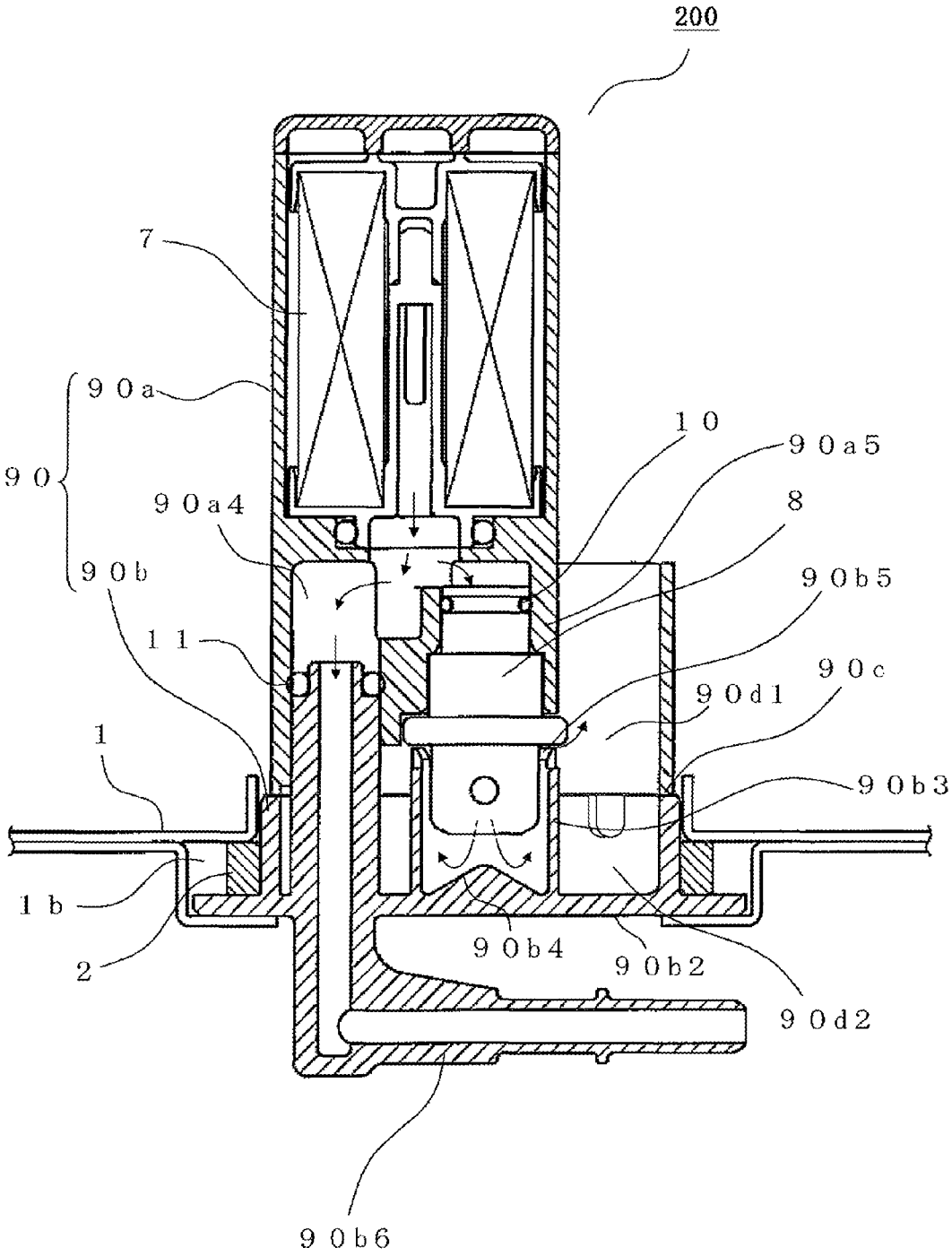
FIG. 6 is a cross section showing a fuel supply equipment according to a second embodiment of the invention.

A second embodiment of the invention will be described on the basis of FIG. 6. FIG. 6 is a cross section showing a fuel supply equipment according to the second embodiment of the invention.

The first embodiment above has described a case where the flange 4 serving as the lid member is formed of an iron plate in a disc shape and the second case 9*b* is formed as one component so that the first case 9*a* and the second case 9*b* are supported on the flange 4 by the attachment stay 4*c* serving as a supporting member. By contrast, the second embodiment will describe a case where a flange serving as a lid member and a second case are integrally molded using thermoplastic resin.

In a fuel supply equipment 200 of FIG. 6, a case 90 is formed of a first case 90*a* and a second case 90*b* and made of thermoplastic resin, such as nylon resin and polyacetal resin. The first case 90*a* accommodates a fuel pump 5 not shown herein and a fuel filter 7. The second case 90*b* accommodates a suction filter 6 and a pressure regulator 8.

The second case 90*b* is integrally molded with a lid member that covers an opening 1*b* of the fuel tank 1 and, as in the first embodiment above, air bubble suppressing members 90*b*3 and 90*b*4 that suppress air bubbles in excess fuel discharged from a pressure regulator 8 are integrally molded with the second case 90*b*.

The second case 90*b* has an integrally-molded fuel discharge pipe 90*b*6. The first case 90*a* and the second case 90*b* are molded into one piece by fixedly attaching the second case 90*b* and the first case 90*a* liquid-tightly on a welding surface 90*c* by thermal welding, such as thermal plate welding, spin welding, and ultrasonic welding, after the fuel discharge pipe 90*b*6 is fit by insertion into a first discharge portion 90*a*4 in the first case 90*a* via an O-ring 11 and the upper side of the pressure regulator 8 is fit by insertion into a second discharge portion 90*a*5.

In the fuel supply equipment 200 configured as above, foreign matter in fuel discharged from the fuel pump 5 is removed while the fuel flows through a filter element 7*a* of the fuel filter 7. Fuel discharged from the fuel filter 7 is then adjusted to have a predetermined pressure by the pressure regulator 8 and discharged to the outside of the fuel tank 1 from the fuel discharge pipe 40*a*. The fuel is supplied further to injectors or the like of the internal combustion engine not shown herein.

In a case where a pressure of the fuel discharged from the fuel filter 7 is higher than a predetermined value, excess fuel is returned, for example, into spaces 90*d*1 and 90*d*2 formed in the vicinity of the welding surface 90*c* between the first case 90*a* and the second case 90*b* by the pressure regulator 8, so that the pressure is maintained at the predetermined value.

An operation for excess fuel discharged from the pressure regulator 8 to be returned into the spaces 90*d*1 and 90*d*2 formed in the vicinity of the welding surface 90*c* between the first case 90*a* and the second case 90*b* and accumulated therein will now be described.

A convection flow is developed by the air bubble suppressing members 90*b*3 and 90*b*4. Hence, not only are air bubbles contained in the excess fuel discharged from the pressure regulator 8 reduced but also air bubbles become smaller. The excess fuel in this state flows into the spaces 90*d*1 and 90*d*2 from a top space 90*b*5 in the air bubble suppressing member 90*b*3.

The excess fuel discharged from the pressure regulator 8 flows into the spaces 90*d*1 and 90*d*2 from the top space 90*b*5 in the air bubble suppressing member 90*b*3. However, a channel is narrowed immediately before the top space 90*b*5 in the air bubble suppressing member 90*b*3. Accordingly, the excess fuel flows into the spaces 90*d*1 and 90*d*2 from the top space 90*b*5 in the air bubble suppressing member 90*b*3 in a state where air bubbles contained therein are made further smaller or reduced more.

In addition, air bubbles remaining in the excess fuel flown into the spaces 90*d*1 and 90*d*2 from the top space 90*b*5 in the air bubble suppressing member 90*b*3 are lighter than fuel. Accordingly, air bubbles rise up in the spaces 90*d*1 and 90*d*2. That is to say, air bubbles rise up to a position remote from the suction filter 6. It thus becomes possible to reduce a possibility that remaining air bubbles are substantially sucked into the suction filter 6.

With the fuel supply equipment 200 according to the second embodiment of the invention configured as above, each of the first case 90*a* and the second case 90*b* is made of thermoplastic resin and the first case 90*a* and the second case 90*b* are fixedly attached to each other by thermal welding. Hence, not only can the attachment stay 4*c* serving as a supporting member described above be omitted, but also the second case 90*b* can be compact. The need of the second case 9*b* in the first embodiment above can be therefore eliminated in the independent configuration. Accordingly, it becomes possible to obtain a fuel supply equipment 200 that not only reduces the number of components and an initial cost, such as a mold cost, but also has a simple structure and high rigidity.

While the presently preferred embodiments of the present invention have been shown and described. It is to be understood that these disclosure are for the purpose of illustration and that various changes and modifications may be made without departing from the scope of the invention as set forth in the appended claims.

What is claimed is:

1. A fuel supply equipment attached to a bottom wall of a fuel tank storing fuel, comprising:

a lid member filled in an opening made in the bottom wall and provided with a fuel discharge pipe;

a fuel pump held by the lid member and configured to suck in the fuel within the fuel tank and discharge the fuel to an outside of the fuel tank from the fuel discharge pipe;

a suction filter provided on a suction side of the fuel pump to filter the fuel within the fuel tank that will be sucked into the fuel pump;

a fuel filter provided on a discharge side of the fuel pump to remove foreign matter in the fuel discharged from the fuel pump;

a pressure regulator configured to adjust a pressure of the fuel discharged from the fuel filter to a predetermined pressure and discharge excess fuel of the fuel;

a case configured to accommodate the fuel pump, the suction filter, the fuel filter, and the pressure regulator and accumulate therein the excess fuel discharged from the pressure regulator; and a supporting member provided to the lid member to support the case on the lid member, wherein the excess fuel is discharged into an air bubble suppressing member having a conical body creating a convection flow of the excess fuel.

2. The fuel supply equipment according to claim 1, wherein:

the case is formed of a first case that accommodates the fuel pump and the fuel filter and a second case that accommodates the pressure regulator and the suction filter; and the first case and the second case are latched by a latching means.

3. The fuel supply equipment according to claim 2, wherein:

the second case includes the air bubble suppressing member that suppresses air bubbles in the excess fuel discharged from the pressure regulator.

4. A fuel supply equipment attached to a bottom wall of a fuel tank storing fuel, comprising:

a lid member filled in an opening made in the bottom wall and provided with a fuel discharge pipe;

a fuel pump held by the lid member and configured to suck in the fuel within the fuel tank and discharge the fuel to an outside of the fuel tank from the fuel discharge pipe;

a suction filter provided on a suction side of the fuel pump to filter the fuel within the fuel tank that will be sucked into the fuel pump;

a fuel filter provided on a discharge side of the fuel pump to remove foreign matter in the fuel discharged from the fuel pump;

a pressure regulator configured to adjust a pressure of the fuel discharged from the fuel filter to a predetermined pressure and discharge excess fuel of the fuel;

a case configured to enclose the fuel pump, the suction filter, the fuel filter, and the pressure regulator and accumulate therein the excess fuel discharged from the pressure regulator; and a supporting member provided to the lid member to support the case on the lid member, wherein:

the case is formed of a first case that accommodates the fuel pump and the fuel filter and a second case that accommodates the pressure regulator and the suction filter;

the first case and the second case are latched by a latching means, wherein the excess fuel is discharged into the second case, the second case includes an air bubble suppressing member that suppresses air bubbles in the excess fuel discharged from the pressure regulator, the air bubble suppressing member is formed of a tubular body provided to a discharge portion of the excess fuel of the pressure regulator, and a conical body provided consecutively with a bottom portion of the tubular body.

5. A fuel supply equipment attached to a bottom wall of a fuel tank storing fuel, comprising:

a lid member filled in an opening made in the bottom wall and provided with a fuel discharge pipe;

a fuel pump held by the lid member and configured to suck in the fuel within the fuel tank and discharge the fuel to an outside of the fuel tank from the fuel discharge pipe;

a suction filter provided on a suction side of the fuel pump to filter the fuel within the fuel tank that will be sucked into the fuel pump;

a fuel filter provided on a discharge side of the fuel pump to remove foreign matter in the fuel discharged from the fuel pump;

a pressure regulator configured to adjust a pressure of the fuel discharged from the fuel filter to a predetermined pressure and discharge excess fuel of the fuel; and a case configured to enclose the fuel pump, the suction filter, the fuel filter, and the pressure regulator and accumulate therein the excess fuel discharged from the pressure regulator, wherein the lid member and the case are made of thermoplastic resin and the lid member and the case are fixedly attached to each other by thermal welding, and wherein the excess fuel is discharged into an air bubble suppressing member having a conical body creating a convection flow of the excess fuel.

* * * * *